United States Patent [19]

Straitz, III

[11] 4,194,876

[45] Mar. 25, 1980

[54] LIQUID BURNPITS

[75] Inventor: John F. Straitz, III, Meadowbrook, Pa.

[73] Assignee: Combustion Unlimited Incorporated, Jenkintown, Pa.

[21] Appl. No.: 837,700

[22] Filed: Sep. 29, 1977

[51] Int. Cl.[2] ..... F23D 13/20

[52] U.S. Cl. ..... 431/202

[58] Field of Search ..... 431/202

[56] References Cited

U.S. PATENT DOCUMENTS

| | | | |
|---|---|---|---|
| 1,397,501 | 11/1921 | Clark | 431/189 |
| 3,703,349 | 11/1972 | Straitz | 431/202 |
| 3,729,287 | 4/1973 | Strashok | 431/202 |
| 3,730,673 | 5/1973 | Straitz | 431/202 |
| 3,749,546 | 7/1973 | Reed et al. | 431/202 |
| 3,822,983 | 7/1974 | Proctor et al. | 431/202 |
| 3,932,111 | 1/1976 | Liknes et al. | 431/202 |
| 4,065,248 | 12/1977 | Straitz et al. | 431/202 |

*Primary Examiner*—Carroll B. Dority, Jr.

*Attorney, Agent, or Firm*—Z. T. Wobensmith, 2nd; Z. T. Wobensmith, III

[57] ABSTRACT

Liquid burnpits are described comprising elongated rectangular earthen or refractory side and end dike walls for the disposal of liquid and hydrocarbon streams from oil/gas exploration, production, transportation and/or refining. Provisions are made for disposal by combustion of liquid only, gas only, or of liquid and gas, with ignition pilots and with distribution of the flame within the pit for effective combustion with substantial smoke reduction, the supply pipes for the pilots, the ignition for the pilots, and the combustible supply pipes being protected from the high temperatures and radiation from the combustion. The coverings for the dike walls, floor and exterior portions of the supply pipes can be varied to accommodate different operating conditions.

5 Claims, 11 Drawing Figures

LIQUID BURNPITS

BACKGROUND OF THE INVENTION

1. Field of the Invention

This invention relates to burnpits for disposal by combustion of gaseous and liquid hydrocarbons, including light and heavy hydrocarbons with substantial smoke reduction.

2. Description of the Prior Art

It has heretofore been proposed to employ burnpits, usually rectangular in shape, excavated at the surface of the ground and surrounded by dikes of earth or refractory material.

One common form of burnpit comprised a rectangular pit with a substantially flat bottom and with a fluid hydrocarbon delivery pipe extending through one end wall or dike with an unprotected replaceable tip in the combustion space. The tips and pipe due to flame impingement and exposure were quickly destroyed. Serious difficulties and poor performance were encountered with this type of pit because of its tendency to establish an outer combustion zone surrounding an inner evaporation zone. The evaporation zone was starved for oxygen to support combustion so that large quantities of unburned hydrocarbons were vaporized and moved upwardly producing very heavy smoke which discharged into the atmosphere with resultant pollution problems. The heavy smoke at the center blocked the heat from the combustion zone and further aggravated the difficulties. The poor operation resulted in banning the use of burnpits in many places. Most of these burnpits had no pilots or ignition system which required the operating personnel to manually light the waste streams by whatever methods they could improvise.

In addition, if the wind direction was in the opposite direction from that of the discharge of hydrocarbons from the supply pipe the turn back of the flame quickly resulted in destruction of the pipe tip and of exposed portions of the pipe.

If liquid hydrocarbon discharging from the burner tip was blown back under the tip the heat from the burning quickly destroyed the burner tip.

In U.S. Pat. No. 2,462,822 the burning of a combustible medium such as gasoline on the surface of water contained in concrete gutters along the sides of an airfield is illustrated for dispersing of fog and lighting up the landing field. No effective combustion of large quantities of hydrocarbons for disposal is contemplated nor can it be accomplished in that structure.

The British Patent to Bateman, No. 4787 of 1915 shows a rectangular pit for destruction of night soil on a horizontal perforated plate within the pit. No provisions are made for continuous supply of fluid hydrocarbons.

In U.S. Pat. No. 3,749,546 to Reed et al., a pit surrounded by a dike is shown for burning hydrocarbon gas with staged combustion with a multiplicity of gas burners carried at a considerable height on vertical pipes so that there will be a continuing supply of air from beneath the burners to mix with the gas for combustion. Pilots are not shown but are said to be needed.

No horizontal introduction of fluid hydrocarbons into a burnpit through protected piping is shown nor is any attempt made to divide or direct a horizontally directed flame or supply air thereto.

In U.S. Pat. No. 3,822,983 to Proctor et al., a ground flare is shown with a central elongated flat bottom combustion zone surrounded by side and end walls of an earthen bank lined internally with a course of stone, rock, brick or the like, or of refractory material. Along each side and at the bottom of the side walls and transversely to the longitudinal axis of the floor, horizontal parallel tubes set in concrete are provided to supply primary air for combustion. The combustible gas to be burned is delivered through a manifold 17 beneath the floor and through a pair of diverging rows of nozzles into the combustion zone. Steam manifolds are provided in a bed of sand below the aggregate floor and are connected in some manner which is not shown to air moving devices on some of the gas delivery nozzles.

The structures heretofore available have not proven satisfactory for various reasons including poor combustion with high smoke output, lack of adequate protection of burners, pilots, igniters, and piping therefor, lack of availability for other than gaseous hydrocarbons, and other shortcomings.

SUMMARY OF THE INVENTION

In accordance with the invention burnpits are made available for a wide range of combustible hydrocarbons, with improved combustion and substantial reduction of smoke attendant upon better air access to the combustion area, and with adequate protection for the piping against heat from the combustion.

It is the principal object of the invention to provide a burnpit for hydrocarbon combustion having increased capacity and improved combustion.

It is a further object of the invention to provide a burnpit having adequate protection for the burner and associated components.

It is a further object of the invention to provide a burnpit which is simple and inexpensive in construction but which is effective in its action.

It is a further object of the invention to provide a burnpit for operation with substantial reduction of smoke but which does not require the use of steam.

It is a further object of the invention to provide a burnpit having improved provisions for access of air for improved combustion.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
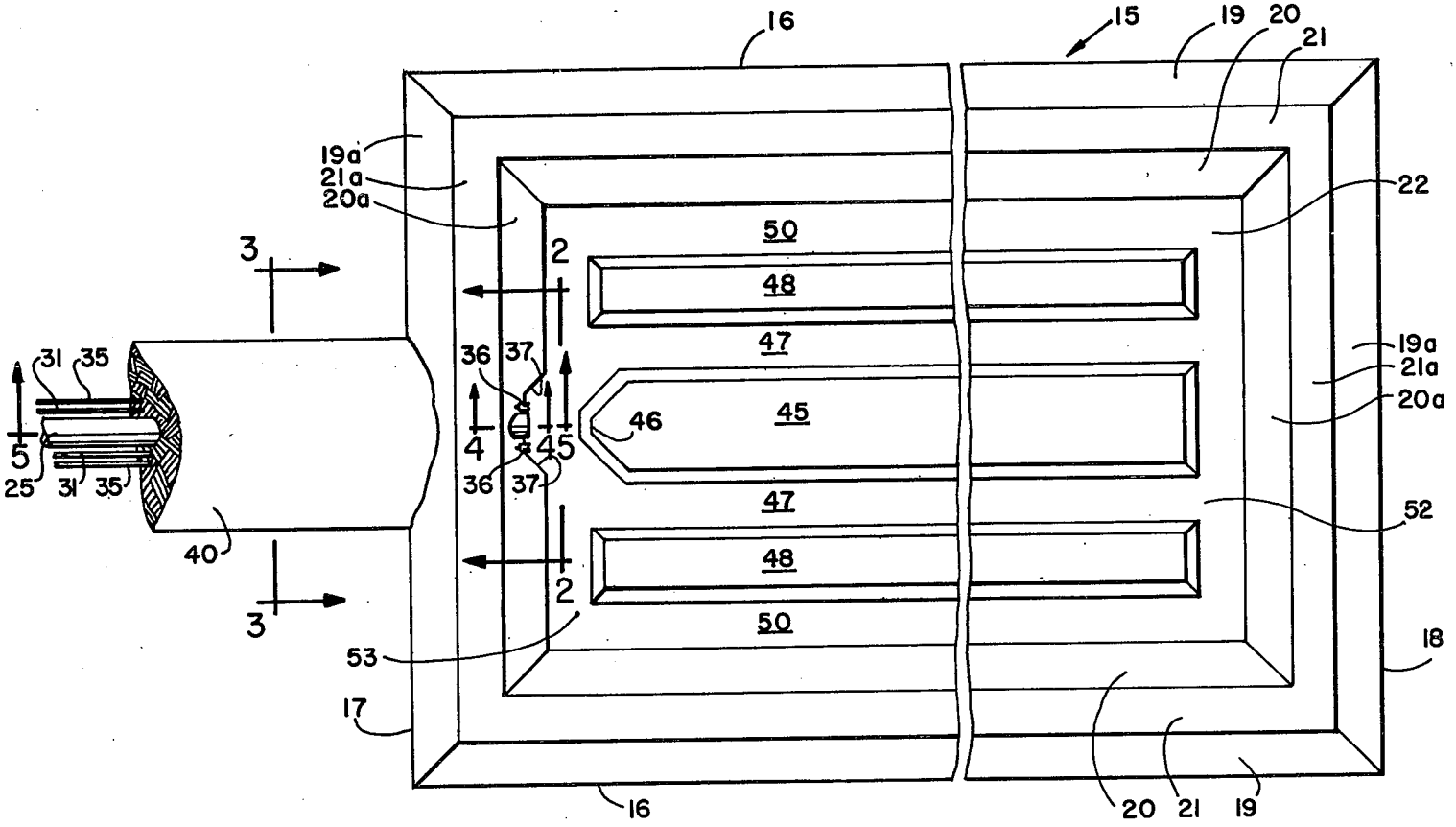
FIG. 1 is a top plan view of one preferred form of burnpit in accordance with the invention for liquid hydrocarbons.
Figure 8:
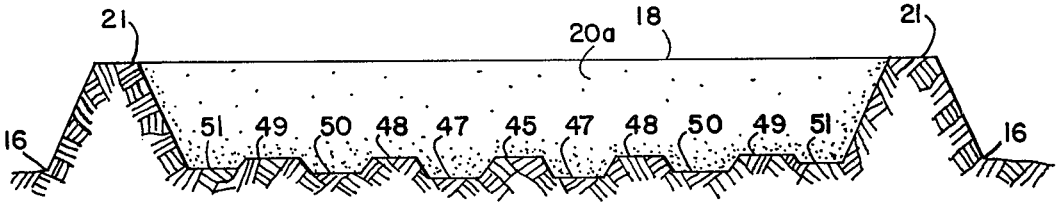
FIG. 8 is a vertical transverse sectional view taken approximately on the line 8—8 of FIG. 7.
Figure 9:
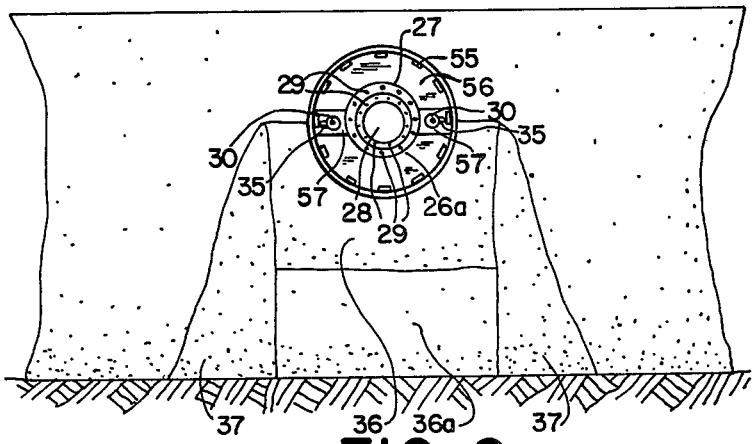
FIG. 9 is a vertical transverse sectional view taken approximately on the line 9—9 of FIG. 7.
Figure 2:
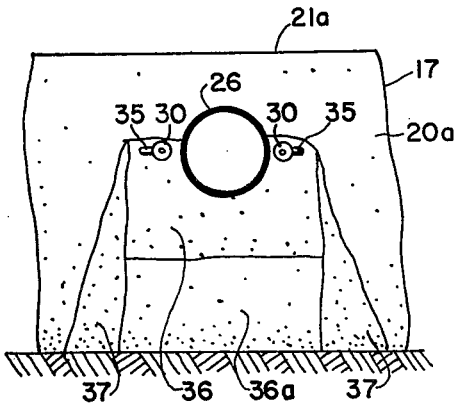
FIG. 2 is a vertical transverse sectional view, enlarged, taken approximately on the line 2—2 of FIG. 1.
Figure 3:
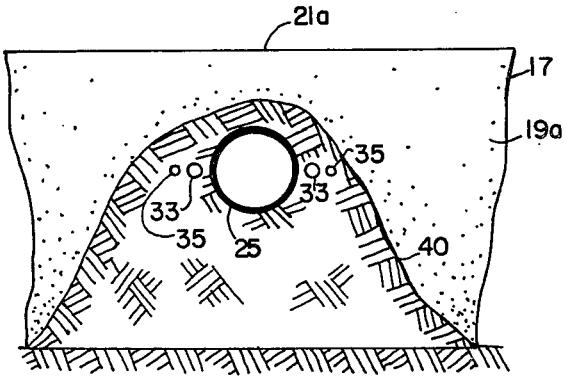
FIG. 3 is a vertical transverse sectional view, enlarged, taken approximately on the line 3—3 of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to the drawings and to FIGS. 1 to 6 thereof, a burnpit 15 is shown, generally rectangular in shape and having parallel side walls 16 and parallel end walls 17 and 18. The walls 16, 17 and 18 are preferably formed as dikes, of earthen material, lined with refractory material, if desired, with inner and outer inclined wall faces 19, 19*a* and 20, 20*a*, and a flat top face portion 21, 21*a*. The dike height, above the floor 22, dependent upon the volume of hydrocarbons to be burned and the restriction to be imposed on horizontal radiation, can be from five to fifteen feet in height, with a burnpit width of the order of forty feet and a burnpit length determined by the length of the flame to be accommodated, plus an additional allowance of the order of 10%.

A hydrocarbon supply pipe 25 is provided preferably for supplying liquid hydrocarbon which may be heavy liquid hydrocarbons and gas, and including benzene, crude oil, tar masses and the like.

The supply pipe 25 preferably has a burner tip 26 detachably connected thereto for replacement if desired and required and terminating close to the face 20*a*, and preferably with a slight downward inclination.

One or more gas fired pilots 30 are provided on pilot gas/air supply pipes 31, the number depending on the size of the pipe 25 and the volume of combustible being discharged through the burner tip 26.

The gas/air delivered to the pilots 30 are preferably supplied from a pilot gas supply pipe 33 with divided flow if desired (see FIG. 6) to an air inducing venturi 34 for each pilot 30 and the pipes 31 are connected to the pilots 30.

An ignition flame delivery pipe 35 is provided preferably one for each pilot 30. The flame front may be generated in any desired manner such as is described in my application for patent for Ignition Panel, filed July 25, 1977, Ser. No. 818,727, now abandoned, or in my application for patent for Ignition System, filed July 15, 1977, Ser. No. 815,911 and now U.S. Pat. No. 4,141,710. The burner tip 26 is preferably set back close to the dike or wall 17 with an inclined wall face 36 and a wall face 36*a* of lesser inclination extending downwardly, and flaring side wall faces 37.

It has been found advisable to protect the supply pipe 25, the pilot gas supply pipe 33 and the ignition flame delivery pipes 35. For this purpose, and as shown in FIGS. 1, 5A, 5B and 7 mound 40 of earth or of medium gravel of one to two inch size is provided in covering relation to these pipes. The length of the mound 40 is dependent upon the exposure to thermal radiation from the burning in the burnpit 10. The radiation may be $\leqq$3000 btu per hour per square foot.

Figure 5A:
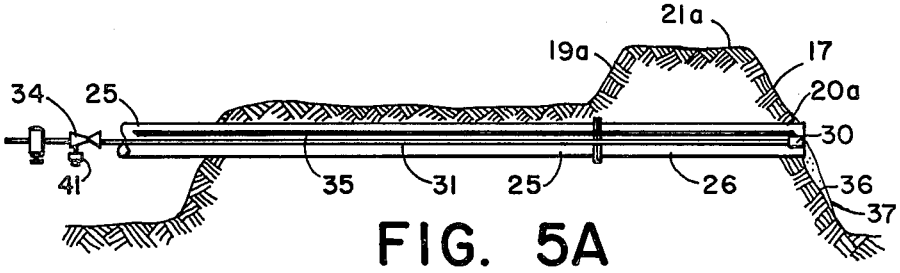
FIG. 5A is a vertical longitudinal sectional view taken approximately on the line 5—5 of FIG. 1 and showing one form of air supply for the pilots for the burner.

If the limit of effectiveness of the high radiation is less than one hundred feet, the length of the mound 40 will be of the same order of length, and as shown in FIG. 5A the venturi 34 may be placed therebeyond with its air inlet provided with a sand and dirt trap 41 similar to those available to protect automotive and other internal combustion engines.

Figure 5B:
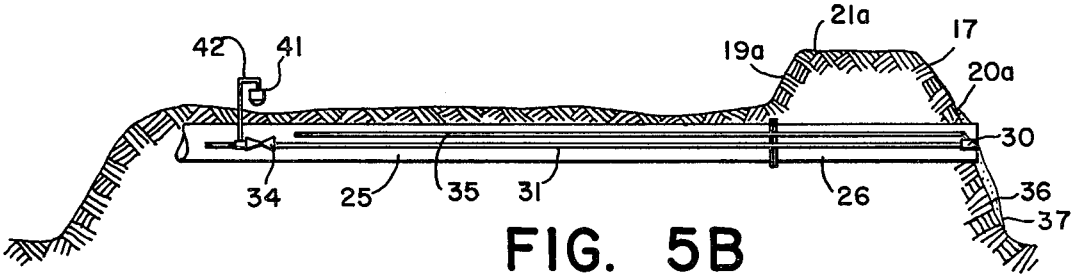
FIG. 5B is a vertical longitudinal sectional view taken approximately on the line 5—5 of FIG. 1 and showing another form of air supply for the pilots for the burner.
Figure 6:
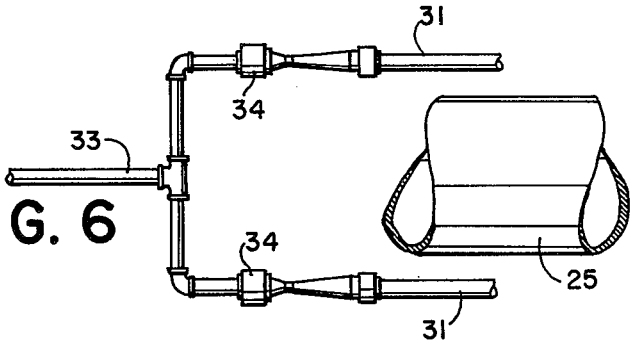
FIG. 6 is a fragmentary horizontal sectional view showing the gas supply to the pilots.
Figure 10:
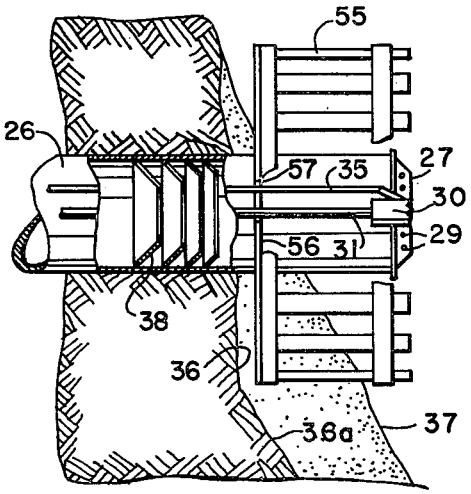
FIG. 10 is a longitudinal sectional view taken approximately on the line 10—10 of FIG. 7.
Figure 4:
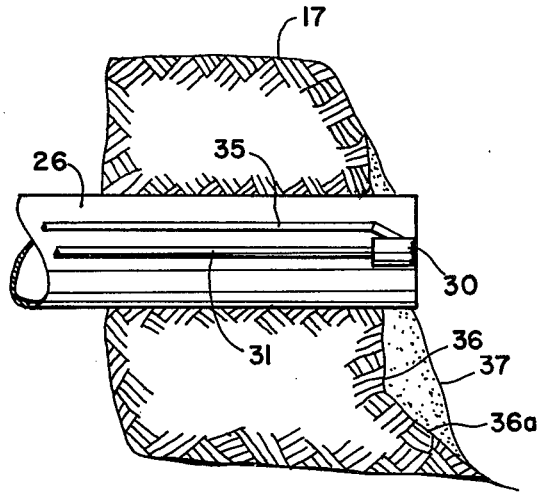
FIG. 4 is a vertical longitudinal sectional view, enlarged, taken approximately on the line 4—4 of FIG. 1.
Figure 7:
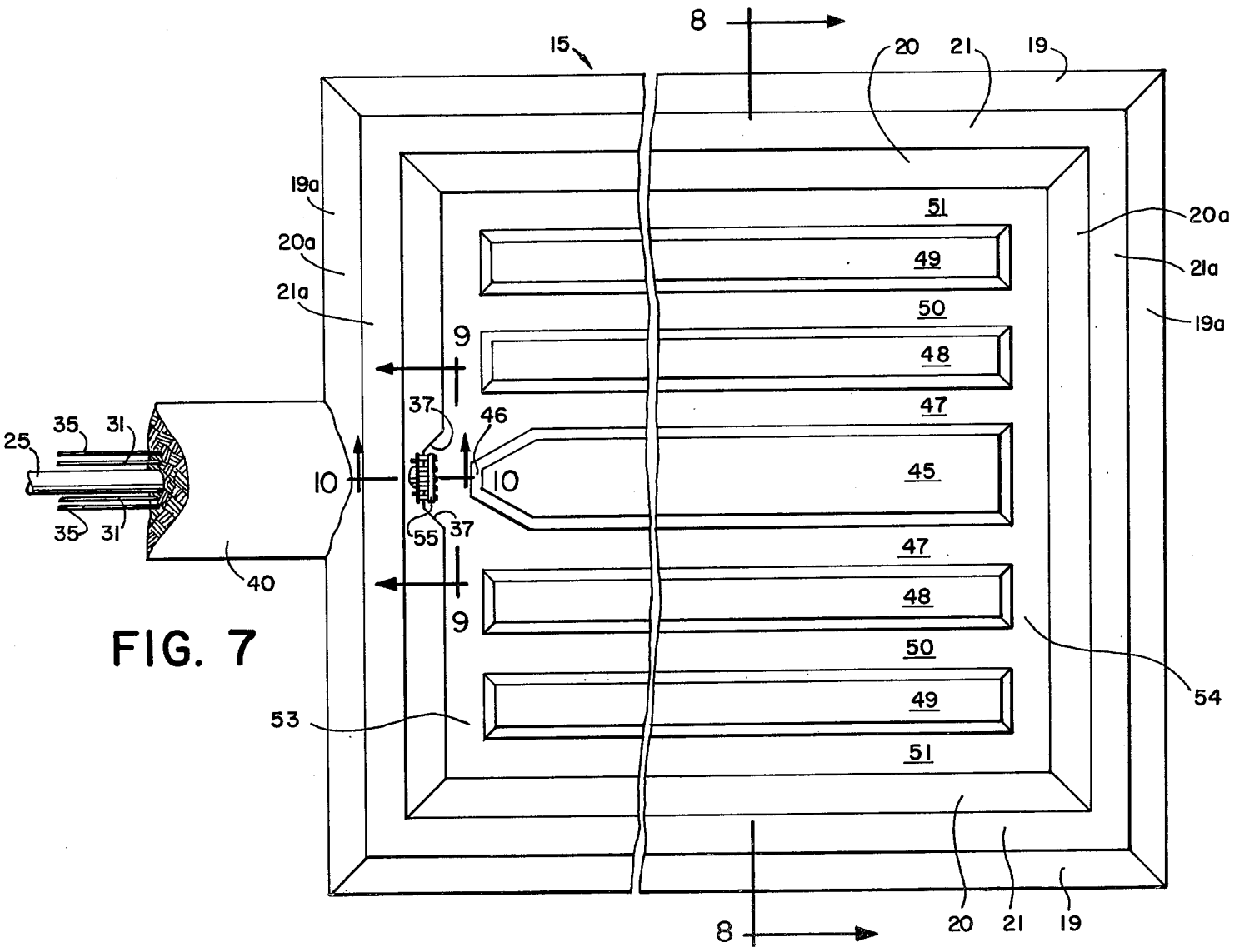
FIG. 7 is a top plan view of another preferred form of burnpit in accordance with the invention for gas or gas liquid hydrocarbons.

If the limit of effectiveness of the high radiation is equal to or more than about one hundred feet the mound will have a corresponding length. The venturi or venturis 34 as shown in FIG. 5B are preferably placed within the mound 40 with air supply pipes 42 connected thereto and extending outside the mound 40 and carry exposed dirt and sand traps 41 in the radiation zone. The traps 41 and pipes 42 are preferably constructed of stainless steel or other materials resistant to the radiant heat to which they are exposed.

If desired, the floor 22 may be flat and with a downward slope away from the wall 17 of the order of six inches per 100 feet. It is preferred, however, to provide in the floor 22 a central longitudinal extending diverter panel 45 with a blunt pointed end 46 and with grooves or channels 47 along each side thereof. Additional longitudinal panels 48 and longitudinal grooves 50 are also preferably provided to improve the access of air to the flame from the burner tip 26 from below.

End grooves 52 and 53 are provided extending transversely and connecting the ends of the longitudinal grooves.

In a specific embodiment for burning about 500,000 pounds of hydrocarbon gases and liquids per hour and for a floor length of about 100 feet, the width of the central diverter 45 is preferably the same as the normal flame width of the flame from the burner tip 26, i.e. about 10 feet. The panels 48 are of a width of about five feet, and the grooves 47 and 50 are of a width of the order of five feet. The depth of the grooves 47 can be of the order of eighteen to twenty inches, and the depth of the grooves 50 can be of the order of twelve to fifteen inches.

The dike walls 16, 17 and 18 can be faced or covered with a suitable covering to reduce erosion. The covering of the inner wall portions 20 and 20*a* can be of coarse gravel or broken fire brick of a size of the order of two to three inches, the faces 36 and 36*a* can be broken fire brick compressed or embedded thereinto or could be of castable refractory cement because of their exposure to high heat. The floor 22 and its panels and grooves are preferably of medium gravel of a size of one to two inches.

Referring now to FIGS. 7, 8, 9 and 10, the structure there shown is similar to that previously described but is particularly suited for the burning of light liquid hydrocarbons which are easy to burn, and including ethane or LNG at low temperatures, propane, butane and the like. For these purposes a different burner tip 26*a* is preferably employed. The burner tips 26 and 26*a* are preferably made of heat resistant material such as Incoloy. The burner tip 26*a* has a flame retention ring 27 with central opening 28 and ports 29. In addition a hollow cylindrical slotted windshield 55 is provided, closed by a plate 56 at its inner end except for openings 57 for the insertion of the pilots 30. The windshield 55 reduces the effect of burn back particularly attendant upon wind in opposition to the flame direction.

The burner tip 26 is preferably also provided with a fluidic diode or vent seal 38 such as is shown in my prior U.S. Pat. No. 3,730,673, dated May 1, 1973, which permits free and relatively unrestricted flow through the flame retention ring 27 and its opening 28 but imposes an obstacle or restriction to reverse flow within the burner tip 26.

The floor 22 may be flat, with a downward slope but it is preferred, as shown, as having longitudinal panels 45, 48 and 49 and grooves 47 and 50 as before and additional longitudinal panels 49 and grooves 51, the grooves 51 preferably being still deeper than the groove 50.

The mode of operation will now be pointed out.

Combustible hydrocarbons delivered through the supply pipe 25 are delivered to the burner tip 26 or **26*a* where they are ignited by one or more of the gas fired pilots 30. The pilots 30, if required, are initially ignited by flame fronts supplied thereto by the ignition flame delivery pipe 35**.

The flame from the burner tip 26 passes longitudinally within the burnpit 10 and liquid hydrocarbon falling from the burner tip 26 is divided to a limited extent by the partial panel 45 with its tip 46 so that air available from above the panels 45, 48 and 49 aids the combustion.

Any tendency of the flame to spread results in additional air being available above the panels 45, 48 and 49.

The hydrocarbon mixtures for the burner tip **26*a* with their liquid content have a similar action as to any liquid falling from the burner tip 26*a***. Some small particles of liquid are entrained in the gas and burned in the gas flame.

The burner tips 26 and **26*a*** are close to the wall, are preferably made of heat resistant material, are cooled to some extent by the hydrocarbons being delivered therethrough and by reason of their limited exposure to the radiant heat of combustion and direct flame impingement are not as susceptible to destruction as were the burner tips heretofore utilized.

The supply pipe 25, the supply pipes 31 and 33, and the flame delivery pipe 35 are protected from radiant heat by the end wall 17 and the mound 40, air being supplied to the verturis 34 either beyond the effective range of the radiant heat or by air supply pipes 42 which are heat resistant and protected from entry of sand and dirt by the traps 41.

I claim:

1. A burnpit comprising an elongated combustion space open at the top and enclosed along the sides within opposite pairs of spaced side and end dikes and having a floor, a supply pipe for supplying fluent hydrocarbons for combustion in said burnpit, one of said end dikes having a burner head at an inner side face portion thereof and spaced above said floor to which said supply pipe is connected, and means contiguous to said burner head for igniting fluent hydrocarbons discharged from said burner head, said floor having a plurality of panels extending longitudinally therealong separated by a plurality of channels.

2. A burnpit comprising an elongated combustion space open at the top and enclosed along the sides within opposite pairs of spaced side and end dikes and having a floor, a supply pipe for supplying fluent hydrocarbons for combustion in said burnpit, one of said end dikes having a burner head at an inner side face portion thereof and spaced above said floor to which said supply pipe is connected, and means contiguous to said burner head for igniting fluent hydrocarbons discharged from said burner head, said floor having a plurality of panels extending longitudinally therealong separated by a plurality of channels, and transverse channels connecting the longitudinal channels.

3. A burnpit comprising an elongated combustion space open at the top and enclosed along the sides within opposite pairs of spaced side and end dikes and having a floor, a supply pipe for supplying fluent hydrocarbons for combustion in said burnpit, one of said end dikes having a burner head at an inner side face portion thereof and spaced above said floor to which said supply pipe is connected, and means contiguous to said burner head for igniting fluent hydrocarbons discharged from said burner head, said floor having a plurality of panels extending longitudinally therealong separated by a plurality of channels, one of said panels being centrally disposed on said floor and parallel to the longitudinal axis of the burner head.

4. A burnpit as defined in claim 3 in which said centrally disposed panel has a converging tip contiguous to the burner head portion.

5. A burnpit comprising an elongated combustion space open at the top and enclosed along the sides within opposite pairs of spaced side and end dikes and having a floor, a supply pipe substantially horizontally disposed for supplying fluent hydrocarbons for combustion in said burnpit, one of said end dikes having a burner head portion on said supply pipe terminating at an inner side face portion of said dike and spaced above said floor for delivering gaseous hydrocarbons longitudinally inwardly into said space for combustion along and above said floor and delivering liquid hydrocarbons for combustion along said floor, said face portion of said end dike sloping outwardly toward said floor, means contiguous to said burner head portion for igniting fluent hydrocarbons discharged from said burner head portion, a mound extending from said one of said end dikes, said supply pipe for fluent hydrocarbons being disposed within and protected by said mound, said means for igniting including a pilot and a combustible gas supply pipe connected to said pilot, said combustible gas supply pipe being disposed within and protected by said mound, said combustible gas supply pipe having a venturi therein for supply of air to said combustible gas supply pipe, said venturi being disposed within said mound, and a heat resistant air supply member being disposed exteriorly of said mound and connected to said venturi.

* * * * *